US010082348B2

(12) United States Patent
Crook et al.

(10) Patent No.: US 10,082,348 B2
(45) Date of Patent: Sep. 25, 2018

(54) HEAT EXCHANGER TUBE-TO-HEADER SEALING SYSTEM

(71) Applicant: Enterex America LLC, Westbrook, CT (US)

(72) Inventors: Richard F. Crook, Westbrook, CT (US); John A Kolb, Westbrook, CT (US)

(73) Assignee: ENTEREX AMERICA LLC, Westbrook, CT (US)

( * ) Notice: Subject to any disclaimer, the term of this patent is extended or adjusted under 35 U.S.C. 154(b) by 219 days.

(21) Appl. No.: 14/844,553

(22) Filed: Sep. 3, 2015

(65) Prior Publication Data

US 2016/0084591 A1 Mar. 24, 2016

Related U.S. Application Data

(60) Provisional application No. 62/053,974, filed on Sep. 23, 2014.

(51) Int. Cl.
*F28F 9/02* (2006.01)
*F28F 7/00* (2006.01)
(Continued)

(52) U.S. Cl.
CPC ..... *F28F 9/165* (2013.01); *F28D 1/05316* (2013.01); *F28D 1/05366* (2013.01);
(Continued)

(58) Field of Classification Search
CPC ..... F28F 9/0226; F28F 9/0236; F28F 9/0239; F28F 9/041; F28F 9/04; F28F 9/06; F28F 9/16; F28F 9/162; F28F 9/165; F28F 9/167; F28F 9/0229; F28F 9/14; F28F 2230/00; F28F 2265/26; F28F 2275/06;
(Continued)

(56) References Cited

U.S. PATENT DOCUMENTS 2,969,956 A * 1/1961 Forgo ..... F28F 9/06 165/162
3,447,603 A 6/1969 Jones
(Continued)

FOREIGN PATENT DOCUMENTS

CN 201229142 Y 4/2009

*Primary Examiner* — Jason Thompson
(74) *Attorney, Agent, or Firm* — DeLio, Peterson & Curcio LLC; David R. Pegnataro

(57) ABSTRACT

A tube-to-header sealing system for a heat exchanger comprises a pair of mating header plates, each header plate having a wall with a plurality of openings therein and including a continuous depression along the circumference of each header plate opening which forms one-half of an O-ring groove. Each of a plurality of O-rings is positioned in each O-ring groove and the header plates are secured together such that the header plate plurality of openings are aligned and trap each of the plurality of O-rings in O-ring grooves. A plurality of spaced-apart tubes each having a tube end secured in an opening in the wall of the header to form a tube-to-header joint are expanded outwardly to provide sufficient O-ring deformation to obtain a seal. In service, the resiliency of the O-ring seal allows for expansion and contraction of the tubes without the build-up of high stresses at the tube-to-header joint.

9 Claims, 6 Drawing Sheets

(51) Int. Cl.
*F28F 9/16* (2006.01)
*F28F 9/14* (2006.01)
*F28D 1/053* (2006.01)
*F28D 21/00* (2006.01)

(52) U.S. Cl.
CPC ..... *F28F 9/0229* (2013.01); *F28F 9/14* (2013.01); *F28D 2021/008* (2013.01); *F28F 2230/00* (2013.01); *F28F 2265/26* (2013.01); *F28F 2275/06* (2013.01); *F28F 2275/10* (2013.01); *F28F 2275/125* (2013.01)

(58) Field of Classification Search
CPC ..... F28F 2275/10; F28F 2275/125; F28D 1/05316; F28D 1/05366; F28D 2021/008
USPC ..... 165/173, 158, 81
See application file for complete search history.

(56) References Cited

U.S. PATENT DOCUMENTS 3,471,178 A * 10/1969 Roe ..... F16L 23/02 156/289
3,739,840 A 6/1973 Jones
4,191,244 A * 3/1980 Keske ..... F28F 9/06 165/144
4,502,297 A * 3/1985 Winterer ..... F25B 39/02 165/168
4,542,784 A * 9/1985 Welsh ..... H05K 7/1404 165/170
4,651,821 A * 3/1987 Moranne ..... F28D 1/05333 165/173
4,756,361 A 7/1988 Lesage
5,205,354 A 4/1993 Lesage
5,226,235 A 7/1993 Lesage
5,381,858 A * 1/1995 Fredrich ..... F28F 9/162 165/150
5,538,079 A * 7/1996 Pawlick ..... F28D 1/05366 165/153
5,894,649 A 4/1999 Lambert et al.
5,901,784 A * 5/1999 Potier ..... F28F 9/165 138/109
6,247,232 B1 * 6/2001 Lambert ..... B23P 15/26 29/890.043
6,330,747 B1 12/2001 Lambert et al.
6,460,610 B2 10/2002 Lambert et al.
7,234,511 B1 6/2007 Lesage
7,506,681 B2 3/2009 Lesage
8,215,015 B2 7/2012 Lesage
8,296,948 B2 10/2012 Lesage
2007/0169926 A1 * 7/2007 Watanabe ..... F28D 1/05366 165/183
2010/0252242 A1 10/2010 Xiangxun et al.
2011/0024037 A1 * 2/2011 Becnel ..... B21D 53/02 156/295

* cited by examiner

HEAT EXCHANGER TUBE-TO-HEADER SEALING SYSTEM

RELATED APPLICATIONS

This application claims priority to U.S. Application No. 62/053,974, filed on Sep. 23, 2014.

BACKGROUND OF THE INVENTION

1. Field of the Invention

The present invention relates to heat exchangers and, more particularly, to heat exchangers such as engine cooling radiators, charge air coolers, condensers, and the like, in which high stresses in the area of the tube-to-header joint due to temperature fluctuations lead to failure at or below the tube-to-header joint.

2. Description of Related Art

Heat exchangers such as engine cooling radiators, charge air coolers, oil coolers, and the like, typically consist of an inlet tank (or manifold) and an outlet tank (or manifold); a core section between the tanks with inlet and outlet headers connected to the tanks and with multiple fluid tubes running from the inlet header to the outlet header, with cooling fins attached between the tubes; and structural side pieces, one on each side, connected to the inlet and outlet tanks. These side pieces often provide attachments for mounting the heat exchanger.

Each of the fluid tubes is inserted into an opening in the wall of the inlet and outlet headers, respectively, and sealed to form a tube-to-header joint. During operation of the heat exchanger, the fluid-carrying tubes are subject to repeated expansion and contraction as the tubes are alternately heated and cooled, resulting in great stress in the area of the tube-to-header joints as the expanding and contracting tubes try to move the inlet and outlet headers, which are connected to the inlet and outlet tanks, which are restrained from movement by the structural side pieces.

As a result of the expanding and contracting tubes trying to move the immovable headers and tanks, the number one cause of failure of heat exchangers in service is failure of the outer tube-to-header joints or of the tubes adjacent to these joints. Much design effort has been expended in attempts to solve this problem, with examples including heat exchangers with resilient tube-to-header joints which provide sealing between the tubes and headers but allow for relative motion between the two without the build-up of high stresses. Some heat exchanger designs use special grommets in the tube-to-header joint, while others have included headers with molded silicone rubber connecting the header plate to metal inserts which become soldered to the tubes. Another approach to the problem has been to seal the tubes to the headers with molded-in-place room temperature vulcanization (RTV) silicone rubber, which provides both sealing and resiliency. All of these approaches add considerable cost to the heat exchanger over the cost of standard rigid tube-to-header joints.

Therefore, a need exists for a means to prevent end tube-to-header failures with a minimum expenditure of cost, material and labor, while preserving heat exchanger thermal performance.

SUMMARY OF THE INVENTION

Bearing in mind the problems and deficiencies of the prior art, it is therefore an object of the present invention to provide an improved system and method for sealing tube-to-header joints in heat exchangers which allows for relative motion between the tube and header without the build-up of high stresses.

It is another object of the present invention to provide a system for resilient sealing of heat exchanger tube-to-header joints by means of an O-ring seal.

It is another object of the present invention to provide a system for sealing tube-to-header joints in heat exchangers which provides for easy installation of O-rings at the tube-to-header joints.

A further object of the invention is to provide a system for sealing tube-to-header joints in heat exchangers which does not require close-tolerance machined O-ring grooves.

It is yet another object of the present invention to provide an improved system for sealing tube-to-header joints in heat exchangers which does not require brazing at the tube-to-header joint.

Still other objects and advantages of the invention will in part be obvious and will in part be apparent from the specification.

The above and other objects, which will be apparent to those skilled in the art, are achieved in the present invention which is directed to a tube-to-header sealing system for a heat exchanger, comprising a first header plate having a wall with a plurality of openings therein, the first header plate including a continuous depression along the circumference of each of the first header plate openings, each depression forming one-half of an O-ring groove; a plurality of O-rings, each of the plurality of O-rings positioned in an O-ring groove; and a second header plate having a wall with a plurality of openings therein, the second header plate including a continuous depression along the circumference of each of the second header plate openings, each depression forming the other half of the O-ring groove. The second header plate is secured to the first header plate such that the first header plate plurality of openings are aligned with the second header plate plurality of openings, thereby trapping each of the plurality of O-rings in O-ring grooves, and the first and second header plates form a header. A plurality of spaced-apart tubes, each having a tube end secured in an opening in the wall of the header to form a tube-to-header joint, are expanded outwardly to provide sufficient O-ring deformation to obtain a seal.

The second header plate may be secured to the first header plate by spot-welding. The plurality of O-rings may be assembled to the first header plate in one or more sheets, and the sheet or sheets may include at least one hole located where the first and second header plates are spot-welded together. Each of the first and second header plates may include shallow dimples correspondingly positioned with the O-ring sheet at least one hole to increase contact between the first and second header plates during spot-welding.

In another aspect, the present invention is directed to a heat exchanger, comprising a first header plate having a wall with a plurality of openings therein, the first header plate including a continuous depression along the circumference of each of the first header plate openings, each depression forming one-half of an O-ring groove; a plurality of O-rings, each of the plurality of O-rings positioned in an O-ring groove; and a second header plate having a wall with a plurality of openings therein, the second header plate including a continuous depression along the circumference of each of the second header plate openings, each depression forming the other half of the O-ring groove. The second header plate is secured to the first header plate such that the first header plate plurality of openings are aligned with the second header plate plurality of openings, thereby trapping each of the plurality of O-rings in O-ring grooves, and the first and second header plates form a header. A plurality of spaced-apart tubes, each having a length with a midpoint in the length of the tube and having a tube end secured in an opening in the wall of the header to form a tube-to-header joint, are expanded outwardly to provide sufficient O-ring deformation to obtain a seal. A plurality of outer fins are attached between the plurality of tubes and centered about the midpoint in the length of the tubes, the outer fins having ends spaced from the tube-to-header joint to form a free-of-fin area extending therebetween. The plurality of outer fins are capable of transferring heat between a fluid passing through the plurality of tubes and the exterior of the outer fins.

The second header plate may be secured to the first header plate by spot-welding. The plurality of O-rings may be assembled to the first header plate in one or more sheets, and the sheet or sheets may include at least one hole located where the first and second header plates are spot-welded together. Each of the first and second header plates may include shallow dimples correspondingly positioned with the O-ring sheet at least one hole to increase contact between the first and second header plates during spot-welding.

In yet another aspect, the present invention is directed to a method of sealing a tube-to-header joint for a heat exchanger, comprising the steps of: providing a first header plate having a wall with a plurality of openings therein, the first header plate including a continuous depression along the circumference of each of the first header plate openings, each depression forming one-half of an O-ring groove; providing a plurality of O-rings, each of the plurality of O-rings positioned in an O-ring groove; and providing a second header plate having a wall with a plurality of openings therein, the second header plate including a continuous depression along the circumference of each of the second header plate openings, each depression forming the other half of the O-ring groove. The method includes securing the second header plate to the first header plate such that the first header plate plurality of openings are aligned with the second header plate plurality of openings trapping each of the plurality of O-rings in O-ring grooves, the first and second header plates forming a header; providing a plurality of spaced-apart tubes having a tube end capable of being secured in an opening in the wall of the header to form a tube-to-header joint; inserting the plurality of tube ends into the openings in the wall of the header to form a tube-to-header joint; and expanding each of the tubes outwardly to provide the necessary O-ring deformation required to obtain a seal.

The step of securing the second header plate to the first header plate may comprise spot-welding. The plurality of O-rings may be assembled to the first header plate in one or more sheets, and the sheet or sheets may include at least one hole located where the first and second header plates are spot-welded together. Each of the first and second header plates may include shallow dimples correspondingly positioned with the O-ring sheet at least one hole to increase contact between the first and second header plates during spot-welding.

In still another aspect, the present invention is directed to a method of securing a first fixture to a second fixture, comprising the steps of: providing a first fixture having a plurality of spaced openings therein; providing a sheet of O-rings including a plurality of O-rings spaced by tabs to correspond to a distance between each spaced opening; assembling the sheet of O-rings to the first fixture without severing the tabs such that each of the plurality of O-rings is positioned around one of the spaced openings in the first fixture; and securing the first fixture to the second fixture such that the first fixture plurality of openings are aligned with the second fixture plurality of openings trapping each of the plurality of O-rings in O-ring grooves and forming a seal.

The first fixture may be a first header plate for a heat exchanger core, the first header plate including a continuous depression along the circumference of each of the first header plate openings, each depression forming one-half of the O-ring groove, and the second fixture may be a mating header plate for the heat exchanger core, the mating header plate including a continuous depression along the circumference of each of the mating header plate openings, each depression forming the other half of the O-ring groove. The first header plate and mating header plate may be secured to form a header for the heat exchanger core.

The method may further include the steps of: providing a plurality of spaced-apart tubes having a tube end capable of being secured in an opening in the header to form a tube-to-header joint; inserting the plurality of tube ends into the openings in the header to form tube-to-header joints; and expanding each of the tubes outwardly to provide the necessary O-ring deformation required to obtain a seal.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE EMBODIMENT(S)

Figure 1:
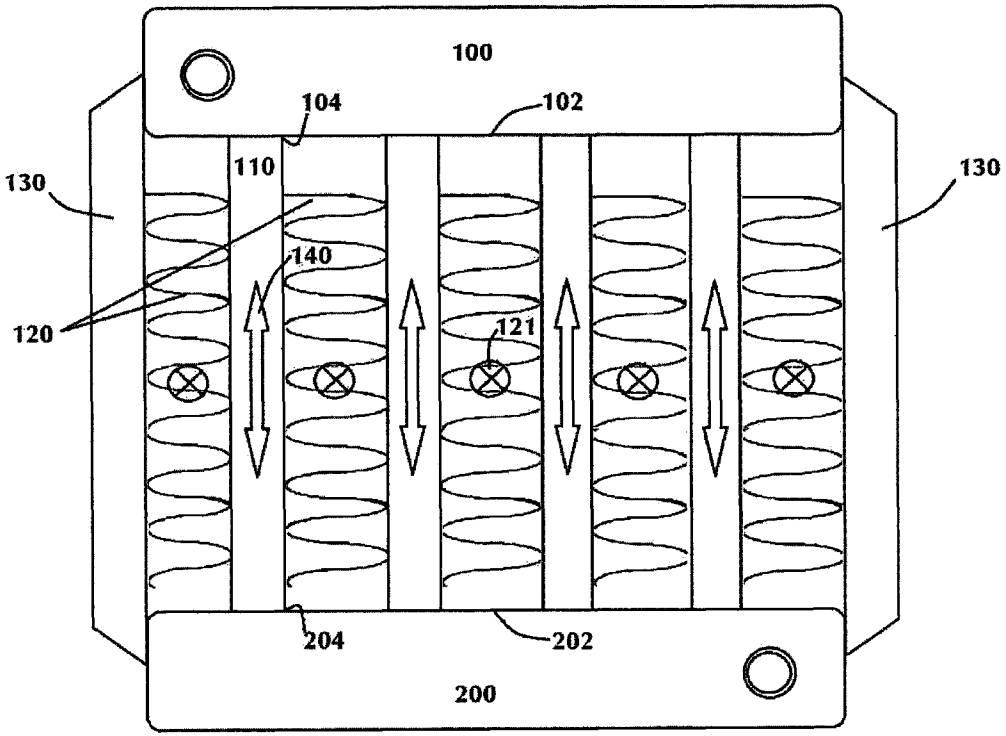
FIG. 1 (PRIOR ART)
FIG. 1 depicts a front elevational view in the direction of cooling air flow of a typical heat exchanger assembly of the prior art.

In describing the embodiments of the present invention, reference will be made herein to FIGS. 1-6 of the drawings in which like numerals refer to like features of the invention.

Air-cooled heat exchangers such as engine cooling radiators, charge air coolers, oil coolers, and the like, typically consist of an inlet tank (or manifold) and an outlet tank (or manifold); a core section between the tanks with inlet and outlet headers connected to the tanks and with multiple fluid tubes running from the inlet header to the outlet header, with cooling fins attached between the tubes; and structural side pieces, one on each side, connected to the inlet and outlet tanks to provide structural strength to the assembly. These side pieces often provide attachments for mounting the heat exchanger to a vehicle or other structure and further act to prevent the inlet and outlet tanks from moving during operation. The cooling fins are attached between the structural side pieces and the outermost tubes, as well as between adjacent tubes, and are positioned such that the fins are centered around a midpoint in the length of the fluid-carrying tubes, with a fin-free area adjacent the header portion of the inlet and outlet tanks. The region between the end of the cooling fins and the header is known as the "free-of-fin" area. The free-of-fin area begins where the cooling fins end.

During operation of the heat exchanger, heated fluid enters the inlet tank, flows through the core tubes to the outlet tank, and is cooled while passing through the tubes by ambient cooling air passing over the fins. The heated fluid increases the temperature of the tubes, causing them to expand in length. When the system is shut down, the tubes cool and contract. This expansion and contraction of the tubes tries to increase and decrease the distance between the top and bottom headers, which are attached to the top and bottom tanks. However, the structural side pieces often restrain the tanks from moving, resulting in great stress at the tube-to-header joints as the expanding and contracting tubes try to move the immovable tanks. The result is high stresses in the area of the tube-to-header joint. As a result of the expanding and contracting tubes trying to move the immovable tanks, the number one cause of failure of heat exchangers in service is failure of the outer tube-to-header joints or the tubes adjacent to these joints. In units in which the tube-to-header joint is soldered, this usually results, in time, in failure of the tube-to-header joint. In units in which the tube-to-header joint is made by brazing or welding, and is therefore much stronger than a soldered joint, the eventual failure is a break in the tubing just below the tube-to-header joint in the free-of-fin area.

The present invention is directed to a system and method for sealing the tube-to-header joints in heat exchangers with O-rings which does not require close-tolerance machined O-ring grooves. The system consists of producing by stamping two mating header plates for each header. Each header plate includes a plurality of clearance holes for heat exchanger core tubes to pass through, and around each clearance hole is a depression forming one half of an O-ring groove. O-rings are assembled into these depressions, and the mating header plate is placed on top of the lower plate and secured, thereby trapping the O-rings in their O-ring grooves. The assembled header is then slid over the tube ends of the heat exchanger core to its required location, either manually or through automation. After the header is fitted over the tube ends, the tubes are then expanded internally by mandrels to provide the necessary O-ring deformation required to obtain a seal. In service, the resiliency of the O-ring seal allows for expansion and contraction of the tubes without the build-up of high stresses at the tube-to-header joint.

The present invention is applicable to many types of heat exchangers, however because the tubes of a charge air cooler (or intercooler) tend to be much larger in cross-section than those of radiators or condensers, the description used herein will primarily refer to application in a charge air cooler.

Certain terminology is used herein for convenience only and is not to be taken as a limitation of the invention. For example, words such as "upper," "lower," "left," "right," "horizontal," "vertical," "upward," and "downward" merely describe the configuration shown in the drawings. For purposes of clarity, the same reference numbers may be used in the drawings to identify similar elements.

Referring now to FIG. 1, a typical heat exchanger assembly of the prior art is shown, with cooling air flow in direction 121 into or out of the page. The heat exchanger assembly consists of an inlet tank or manifold 100, an outlet tank or manifold 200, a plurality of fluid-carrying tubes 110 extending between the tanks or manifolds, and structural side pieces 130, one on either side, connected to both the inlet tank 100 and outlet tank 200. Headers 102, 202 are normally provided on the tanks for mechanical attachment and connection of the tubes to the tanks.

As shown in FIG. 1, a typical heat exchanger core is comprised of a plurality of vertical, parallel, spaced tubes 110, with extended outer surface fins 120 attached between them for transferring heat to passing airflow. Tubes and fins in heat exchangers are typically made of aluminum or an aluminum alloy, and may be clad or coated with braze material, but other metals and alloys may also be used such as copper. Tubes 110 are inserted into, and sealed to, openings (not shown) in the walls of inlet header 102 and outlet header 202, respectively, to make up the core. The headers 102, 202 are connected to, or part of, the inlet and outlet tanks or manifolds 100, 200 and structural side pieces 130 connect the tanks to make the heat exchanger. Each of the tubes has a tube end secured in an opening in the header wall to form a tube-to-header joint 104, 204. The tube-to-header joint is typically soldered or brazed to prevent leakage around the tubes and header or manifold. Oval tubes are typically utilized for close tube spacing for optimum heat transfer performance of the heat exchanger, although other tube shapes and cross-sections may be utilized. As used herein, the term "oval" refers to any non-circular shaped axial cross-section (i.e. perpendicular to the axis of the tube) having a generally smoothly curving periphery, such as an ellipse or a rectangle with rounded corners, or other obround or egg shape.

In operation, heated fluid enters the inlet tank 100, flows through the core tubes 110 to the outlet tank 200, and is cooled while passing through the tubes 110 by ambient cooling air passing over the outer fins 120. The heated fluid increases the temperature of the tubes 110, causing them to expand in length. When the system is shut down, the tubes 110 cool and contract. The thermal expansion and contraction of the tubes 110 is represented in FIG. 1 by arrows 140. This expansion and contraction of the tubes tries to increase and decrease the distance between the inlet and outlet headers and tanks. However, the structural side pieces 130 restrain the tanks from moving, resulting in great stress at the tube-to-header joints 104, 204 as the expanding and contracting tubes try to move the immovable tanks.

Figure 2:
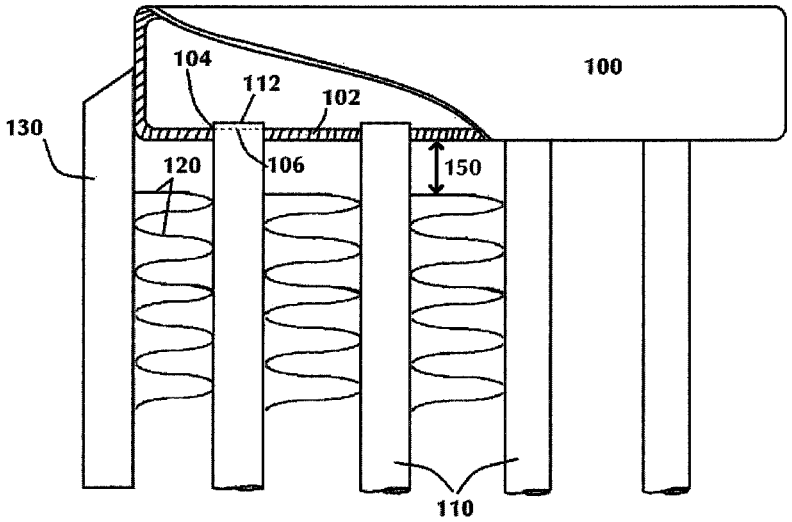
FIG. 2 (PRIOR ART)
FIG. 2 depicts a front elevational view of a portion of a typical heat exchanger assembly, partially sectioned, to show a header portion of an inlet tank, heat exchanger tubes sealed at tube-to-header joints, cooling fins and structural side pieces

FIG. 2 shows a portion of a typical heat exchanger assembly, partially sectioned, to show the inlet header 102 attached to an inlet tank or manifold 100, with heat exchanger tubes 110 inserted into openings 106 in the header wall and sealed at tube-to-header joints 104. FIG. 2 further shows a structural side piece 130 with outer fins 120 between the structural side piece 130 and the outermost heat exchanger tube 110 and also between adjacent tubes 110. As shown in FIG. 2, the cooling fins 120 are positioned such that the fins are centered around a midpoint of the fluid-carrying tubes, with a fin-free area adjacent the inlet header 102 attached to the inlet tank 100. As shown in FIG. 2, the free-of-fin area 150 is considered to begin at the tops of the outer cooling fins and extends to the header.

The outermost tube-to-header joint 104 is subject to repeated stress during operation of the heat exchanger, and therefore is at the greatest risk of failure. In heat exchanger units wherein the tube-to-header joint is brazed or welded, and therefore stronger than a soldered joint, the eventual failure is typically a break in the tubing just below the tube-to-header joint in the free-of-fin area. The present invention provides an improved heat exchanger assembly and is directed to a tube-to-header sealing method and system which provides for sealing of the tubes to the headers while allowing for expansion and contraction of the tubes in service by means of a resilient O-ring seal, without the build-up of high stresses in the critical portion of the tube including the free-of-fin area along the tube between the point where the outer fins end and where the tube passes through, and is joined to, the header 102.

Figure 3:
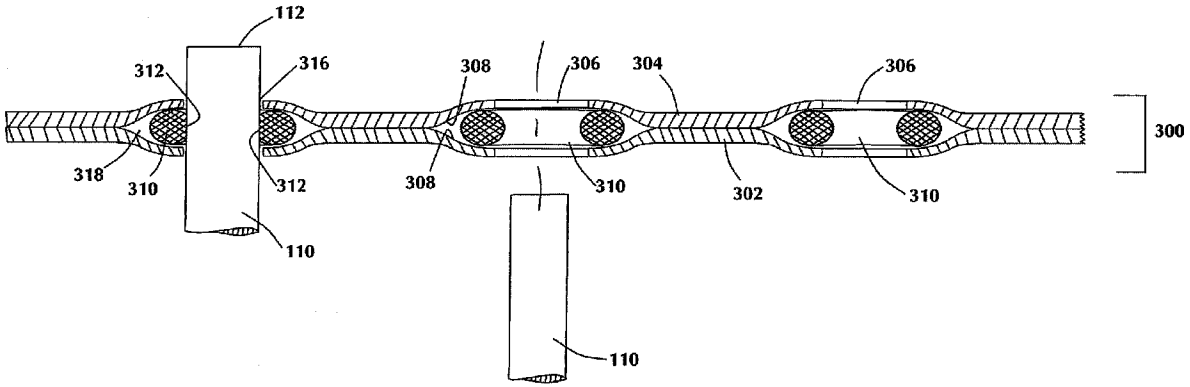
FIG. 3 depicts a cross-sectional view of one embodiment of the tube-to-header sealing system of the present invention, showing a partial segment of the inlet header portion of a heat exchanger comprising first and second mating header plates defining the inlet header. The inlet manifold connected to the header is not shown, for clarity.

FIG. 3 depicts one embodiment of the tube-to-header sealing system of the present invention, shown as a partial segment of the inlet header portion of a heat exchanger. For clarity, the inlet manifold, outlet header and manifold, structural side pieces, and outer fins, oriented substantially as in FIGS. 1 and 2, are not shown. As shown in FIG. 3, a header 300 is comprised of a pair of mating header plates 302, 304. Preferably, the header plates are mirror-images of each other and therefore can be easily located with respect to each other because they are identical. Moreover, because the header plates 302, 304 are identical, the same tooling may be used to produce each plate. The thickness of each header plate may be selected to provide the required total header strength, per system requirements. Each header plate includes a wall having a plurality of clearance holes 306 for heat exchanger core tubes 110 to pass through. In an exemplary embodiment, oval core tubes and corresponding clearance holes are utilized for close tube spacing for optimum heat transfer performance of the heat exchanger, although other tube shapes and cross-sections may be used. Each of the tubes has a tube end 112 which is secured in an opening 306 in the header wall to form a tube-to-header joint 316. In contrast to the rigid tube-to-header joints of the prior art, which are formed by soldering or brazing the joint, the tube-to-header joint of the present invention is sealed by means of a resilient O-ring seal 312.

Figure 4B:
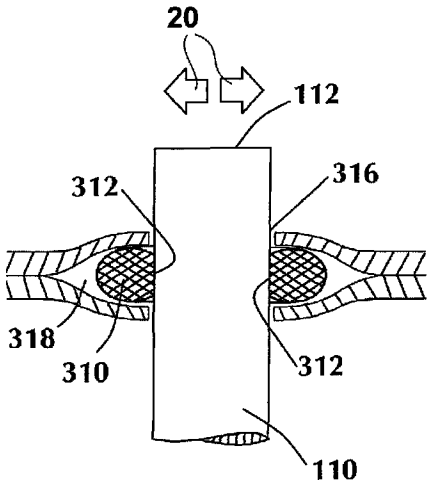
FIG. 4B depicts a cross-section of a partial segment of an assembled header, showing the core tube of FIG. 4A after the tube has been expanded outwardly to obtain an O-ring seal.
Figure 4A:
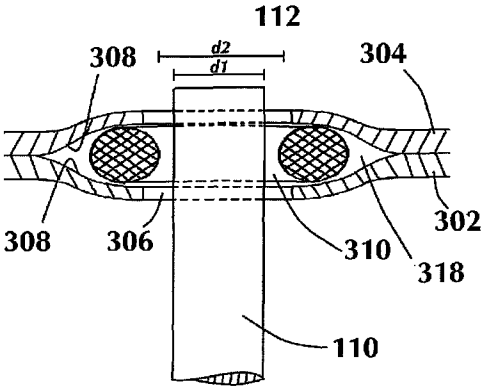
FIG. 4A depicts a cross-section of a partial segment of an assembled header, showing an exemplary heat exchanger core tube inserted into the assembled header prior to expansion of the core tube.

As shown in FIG. 4A, around the circumference of each clearance hole 306 is formed a continuous depression 308 in the header plates 302, 304, each of which comprises one-half of a sealing O-ring groove. A plurality of O-rings 310 are assembled into each of the depressions 308 in one of the header plates 302 and the mating header plate 304 is placed on top of the lower plate and secured, thereby trapping each of the O-rings in their respective O-ring groove 318. In at least one embodiment, as shown in FIG. 4A, O-rings having an oval cross-section may be used, but other axial cross-sections having a generally smoothly curving periphery, such as circular or elliptical, are not precluded. For clarity, FIGS. 4A and 4B depict a segment of an inlet header wherein one heat exchanger core tube has been inserted into a clearance hole in the assembled header to form a tube-to-header joint, however it should be understood that in practice the assembled header will include a plurality of clearance holes which correspond with a plurality of core tubes, and that the assembled header is slid over the tube ends of the heat exchanger core to its required location during assembly of the heat exchanger.

Figure 6:
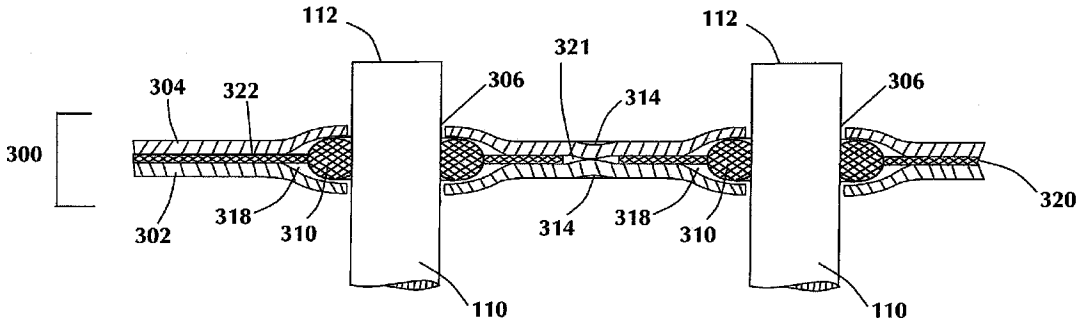
FIG. 6 depicts a cross-sectional view of another embodiment of the tube-to-header sealing system of the present invention, wherein the O-rings are assembled in sheets, showing a partial segment of the inlet header portion of a heat exchanger comprising first and second mating header plates defining the inlet header. The inlet manifold connected to the header is not shown, for clarity.

Referring to FIG. 6, the mating header plates 302, 304 may be secured by spot-welding at a plurality of points between each clearance hole 306. For clarity, FIG. 6 depicts a partial segment of the inlet header portion of a heat exchanger, showing mating header plates 302, 304 which have been spot-welded at a location between two adjacent clearance holes 306 into which core tubes 110 have been inserted and sealed. Spot-welding, rather than brazing, to join the mating header plates allows the O-rings to be installed before joining the two mating header halves, simplifying O-ring installation. It should be understood that spot-welding is only one such method of securing the mating header plates together and that methods other than spot-welding may also be used in accordance with the objects of the present invention.

Figure 5B:
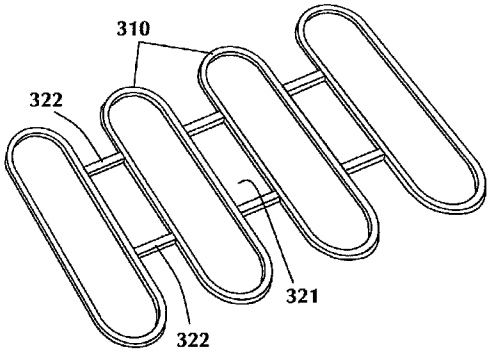
FIG. 5B depicts a perspective view of the O-ring sheet of FIG. 5A prior to assembly between mating header plates.
Figure 5A:
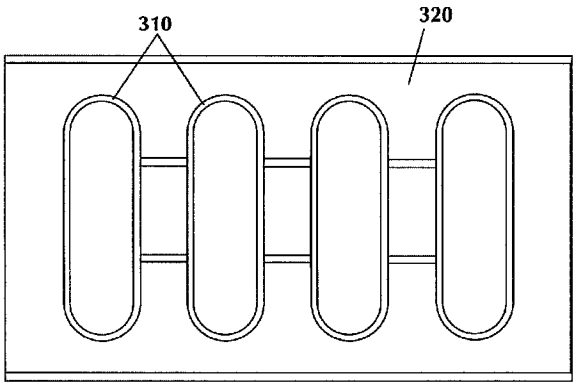
FIG. 5A depicts a top plan view of an exemplary sheet of O-rings.

In an embodiment, the O-rings may be assembled either individually or in one or more sheets. To minimize assembly labor, the O-rings 310 may be assembled in a thin sheet 320, as shown in FIGS. 5A and 5B, which is sealed between the mating header plates 302, 304 during assembly of the header 300 (FIG. 6). O-rings having an oval cross-section may be used, but other axial cross-sections having a generally smoothly curving periphery, such as circular or elliptical, are not precluded. The thin sheets may include one or more tabs 322 spacing the O-rings, with holes or channels 321 between the tabs. As shown in FIG. 6, shallow dimples 314 in the surfaces of the mating header plates 302, 304 may be located where the spot-welding will occur and are located to coincide with the holes or channels 321 between the tabs. The dimples 314 assure increased contact between the header plates during spot-welding. If the O-rings are assembled in one or more sheets, the length of tabs 314 may correspond to the distance between adjacent clearance holes 306, and the O-ring sheets may be assembled to the first header plate 302, without severing the tabs 314, such that each O-ring 310 is positioned in its respective O-ring groove 318.

In an assembled header, each O-ring is positioned in its respective O-ring groove 318 and trapped therein by the mating header plates, whether the O-rings have been assembled individually (FIG. 3) or in one or more sheets (FIG. 6). After securing the mating header plates 302, 304 together, such as by spot-welding in the manner described above, the assembled header 300 with O-rings 310 is then slid over the tube ends 112 of each of tubes in the heat exchanger core to their desired location, either manually or through automation. Another advantage of the present invention is that the space between the mating header plates does not require brazing to be sealed from the heat exchanger fluids, as this is accomplished by the O-ring tube-to-header seals.

As shown in FIG. 4A, the assembly of the header with O-rings to the core tubes is made easier by using tubes with an outer diameter d1 that is less than the inner diameter d2 of the trapped O-rings. As depicted in FIG. 4B, the diameter d1 of the tubes 110 are then expanded outwardly in the direction of arrows 20, such as by the use of a mandrel, to provide the necessary O-ring deformation to obtain a seal 312. It should be understood that in accordance with the objects of the present invention, core tubes with an outer diameter equal to, or slightly larger than, the inner diameter of the trapped o-rings may also be used, as long as the tube end may be inserted through the inner diameter of the O-ring and thereafter expanded to provide the necessary O-ring deformation to obtain a seal. The proper compression of the O-ring seal is provided by expanding the tubes after assembly of the header 300 to the core tubes 110, thus eliminating the requirement for close tolerances on the O-ring groove 318. As further shown in FIG. 4B, tube 110 is expanded outwardly in the direction of O-ring 310 enough to form an O-ring seal 312, but not enough to contact the header plates 302, 304. In service, the resiliency of the O-ring seal allows for linear expansion and contraction of the tubes without the build-up of high stresses at the tube-to-header joint.

Thus the present invention achieves one or more of the following advantages. The present invention provides an improved system and method for sealing tube-to-header joints in heat exchangers which allows for relative motion between the tube and header without the build-up of high stresses. The sealing system provides resilient sealing of heat exchanger tube-to-header joints by means of an inexpensive O-ring seal, as compared to expensive custom grommets or special molded silicone headers. The sealing system requires no close-tolerance machined O-ring grooves, and provides for easy installation of the O-rings, either individually or in sheets. The thickness of the mating header halves can be selected to provide the required total header strength to meet application requirements, and the space between the mating header halves does not require brazing to be sealed from the heat exchanger fluids, as this is accomplished by the O-ring tube-to-header seals. In service, the resiliency of the O-ring seal allows for expansion and contraction of the tubes without the build-up of high stresses at the tube-to-header joint, and prolongs the life of the heat exchanger unit while maintaining heat exchanger thermal performance.

While the present invention has been particularly described, in conjunction with specific embodiments, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A tube-to-header sealing system for a heat exchanger, comprising:

a first header plate having a wall with a plurality of openings therein, the first header plate including a continuous depression along a circumference of each of the first header plate openings, each depression of the first header plate forming one-half of an O-ring groove;

a second header plate having a wall with a plurality of openings therein, the second header plate including a continuous depression along a circumference of each of the second header plate openings, each depression of the second header plate forming the other half of the O-ring groove;

a plurality of O-rings, each of the plurality of O-rings positioned in one of the O-ring grooves formed between the first and second header plates, whereby the wall of the second header plate is in direct contact with and secured to the wall of the first header plate at at least one point between adjacent O-rings such that the first header plate plurality of openings are aligned with the second header plate plurality of openings trapping each of the plurality of O-rings in a respective one of the O-ring grooves, the first and second header plates defining a tube header for a manifold; and a plurality of spaced-apart tubes each having a tube end secured in an opening in the wall of the header to form a tube-to-header joint, each of the tubes being expandable and having an initial outer diameter less than an inner diameter of each of the plurality of O-rings, each of the tubes having been inserted within one of the plurality of O-rings and then expanded outwardly to provide sufficient O-ring deformation to obtain a seal without the tubes contacting either of the first or second header plate.

2. The tube-to-header sealing system of claim 1 wherein the second header plate is secured to the first header plate by spot-welding.

3. The tube-to-header sealing system of claim 2 wherein the plurality of O-rings are assembled to the first header plate in at least one sheet, the at least one sheet including at least one hole located at one of the points where the first and second header plates are spot-welded together.

4. The tube-to-header sealing system of claim 3 wherein each of the first and second header plates includes shallow dimples correspondingly positioned with the O-ring sheet at least one hole to increase contact between the first and second header plates during spot-welding.

5. The tube-to-header sealing system of claim 1 wherein the plurality of O-rings are assembled to the first header plate in at least one sheet.

6. The tube-to-header sealing system of claim 5 wherein the at least one sheet includes tabs spacing adjacent O-rings and corresponding to a distance between adjacent header plates openings.

7. The tube-to-header sealing system of claim 6 wherein the tabs are not severed when the first and second header plates are secured together.

8. The tube-to-header sealing system of claim 1 wherein the first and second header plates are mirror images of each other.

9. The tube-to-header sealing system of claim 1 wherein each of the first and second header plates includes shallow dimples at at least one point between adjacent O-rings to increase contact between the first and second header plates.

* * * * *